US008713762B2

(12) United States Patent
Bates et al.

(10) Patent No.: US 8,713,762 B2
(45) Date of Patent: May 6, 2014

(54) MAGNETIC TIE CLIP

(76) Inventors: Ray C. Bates, San Diego, CA (US); Robert Allen, Lake Elsinore, CA (US)

( * ) Notice: Subject to any disclaimer, the term of this patent is extended or adjusted under 35 U.S.C. 154(b) by 84 days.

(21) Appl. No.: 13/303,023

(22) Filed: Nov. 22, 2011

(65) Prior Publication Data

US 2012/0124781 A1 May 24, 2012

Related U.S. Application Data

(60) Provisional application No. 61/416,166, filed on Nov. 22, 2010.

(51) Int. Cl.
*A41D 25/00* (2006.01)
*A44B 99/00* (2010.01)

(52) U.S. Cl.
USPC ..... 24/66.1; 24/56; 24/66.8; 24/66.2; 24/303

(58) Field of Classification Search
None
See application file for complete search history.

(56) References Cited

U.S. PATENT DOCUMENTS

| | | | | | |
|---|---|---|---|---|---|
| 4,554,710 | A * | 11/1985 | Grant | ..... | 24/66.1 |
| 4,686,716 | A * | 8/1987 | Burns | ..... | 2/152.1 |
| 5,052,083 | A * | 10/1991 | Hammer | ..... | 24/66.2 |
| 2008/0134474 | A1 * | 6/2008 | Uryasov | ..... | 24/303 |

* cited by examiner

*Primary Examiner* — Jack W. Lavinder
(74) *Attorney, Agent, or Firm* — Procopio, Cory, Hargreaves & Savitch LLP

(57) ABSTRACT

A magnetic tie clip is provided, which includes a first component that is fastened with a button on a shirt and a second component which is fastened on a tie. The second component includes a magnet which is magnetically coupled with the first component in order to secure the tie to the shirt. The first component further includes a button fastener which attaches with the button, a magnetic member which is magnetically coupled with the second component, and a connector which flexibly connects the button fastener and the magnetic member. The connector may be set to a length which provides for flexible movement of the magnetic member relative to the button fastener, such that the tie is secured close to the shirt but is permitted to move as the wearer moves.

15 Claims, 6 Drawing Sheets

Clip hanging from a tie

Side view of clip

Clip hanging from a tie

MAGNETIC TIE CLIP

CROSS-REFERENCE TO RELATED APPLICATIONS

This application claims the benefit of U.S. Provisional Application No. 61/416,166, filed Nov. 22, 2010, the contents of which are incorporated herein by reference in their entirety.

FIELD

This invention relates to a tie clip, and in particular, a tie clip having a first component that fastens to a button and second component that fastens to a tie, where the first and second components may be magnetically coupled.

BACKGROUND

Tie clips are used to secure a tie relative to the front of a shirt and typically include a clip having a hinge. The clip is opened and one arm is positioned in front of the tie, while a second arm is inserted into an opening in the front of the shirt that is between the buttons of the shirt. When the clip is closed, the tie is secured to the shirt.

One disadvantage of typical tie clips is that the tie can form wrinkles or folds when the individual moves. For example, when an individual sits down, this can cause a large fold because the relative distance between the clip and the individual's neck has decreased.

Therefore, there is a current need for a tie clip which does not cause wrinkles or folds as the wearer moves.

SUMMARY

Embodiments described herein are directed to a magnetic tie clip which includes a first component that is fastened with a button on a shirt and a second component which is fastened on a tie. The second component includes a magnet which is magnetically coupled with the first component in order to secure the tie to the shirt. The first component further includes a button fastener which attaches with the button, a magnetic member which is magnetically coupled with the second component, and a connector which flexibly connects the button fastener and the magnetic member. The connector may be set to a length which provides for flexible movement of the magnetic member relative to the button fastener, such that the tie is secured close to the shirt but is permitted to move as the wearer moves.

In one embodiment of the invention, a magnetic tie clip comprises a first component which is fastened with a button on a shirt; a second component which is fastened with a tie; and a magnet disposed on the second component, wherein the first component is magnetically coupled with the magnet on the second component.

The first component may comprise a button fastener which is removably fastened with the button; a magnetic member which is magnetically coupled with the magnet; and a connector which flexibly connects the button fastener with the magnetic member.

The button fastener may be a closed loop.

The magnetic member may be a paramagnetic material.

The magnetic member may be a ferromagnetic material.

The magnetic member may include an indentation configured to receive a protrusion on the second component.

The protrusion may be the magnet.

The length of the connector may be adjustable.

The connector may be a chain.

The second component may comprise a front arm upon which the magnet is disposed; a rear arm; and a hinge which rotatbly connects the front arm with the rear arm.

The front arm may be a ferromagnetic material which functions as the magnet.

In another embodiment of the invention, a magnetic tie clip comprises a first component which is fastened with a button on a shirt; a second component which is fastened with a tie; and a magnet disposed on the first component, wherein the first component is magnetically coupled with the magnet on the second component.

The first component may comprise a button fastener which is removably fastened with the button; a magnetic member which comprises the magnet; and a connector which flexibly connects the button fastener with the magnetic member.

The magnetic member may be a ferromagnetic material.

The magnetic member may include a protrustion configured to receive an indentation on the second component.

The magnetic member may weigh between about 10 grams and about 500 grams.

The second component may comprise a front arm upon which the magnet is disposed; a rear arm; and a hinge which rotatbly connects the front arm with the rear arm.

The front arm may be a paramagnetic material.

In a further embodiment of the invention, a method of securing a tie to a shirt comprises fastening a first component with a button on a shirt; fastenining a second component with a tie; and coupling the first component with the second component using a magnet disposed on the second component.

From this description, in conjunction with other items, the advantages of the said invention will become clear and apparent more so based upon the hereinafter descriptions and claims, which are supported by drawings with numbers relating to parts, wherein are described in the following sections containing the relating numbers.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

DETAILED DESCRIPTION OF EXEMPLARY EMBODIMENTS

After reading this description it will become apparent to one skilled in the art how to implement the invention in various alternative embodiments and alternative applications.

However, all the various embodiments of the present invention will not be described herein. It is understood that the embodiments presented here are presented by way of an example only, and not limitation. As such, this detailed description of various alternative embodiments should not be construed to limit the scope or breadth of the present invention as set forth below.

Disclosed herein is a tie clip including a first component and a second component. The first component is configured to be secured to a button on a shirt, and the second component is configured to be secured to a tie. The first component and second component may be magnetically coupled such that the tie is kept close to the shirt via the magnetic attraction between the second component on the tie and the first component on the shirt.

Figure 1:
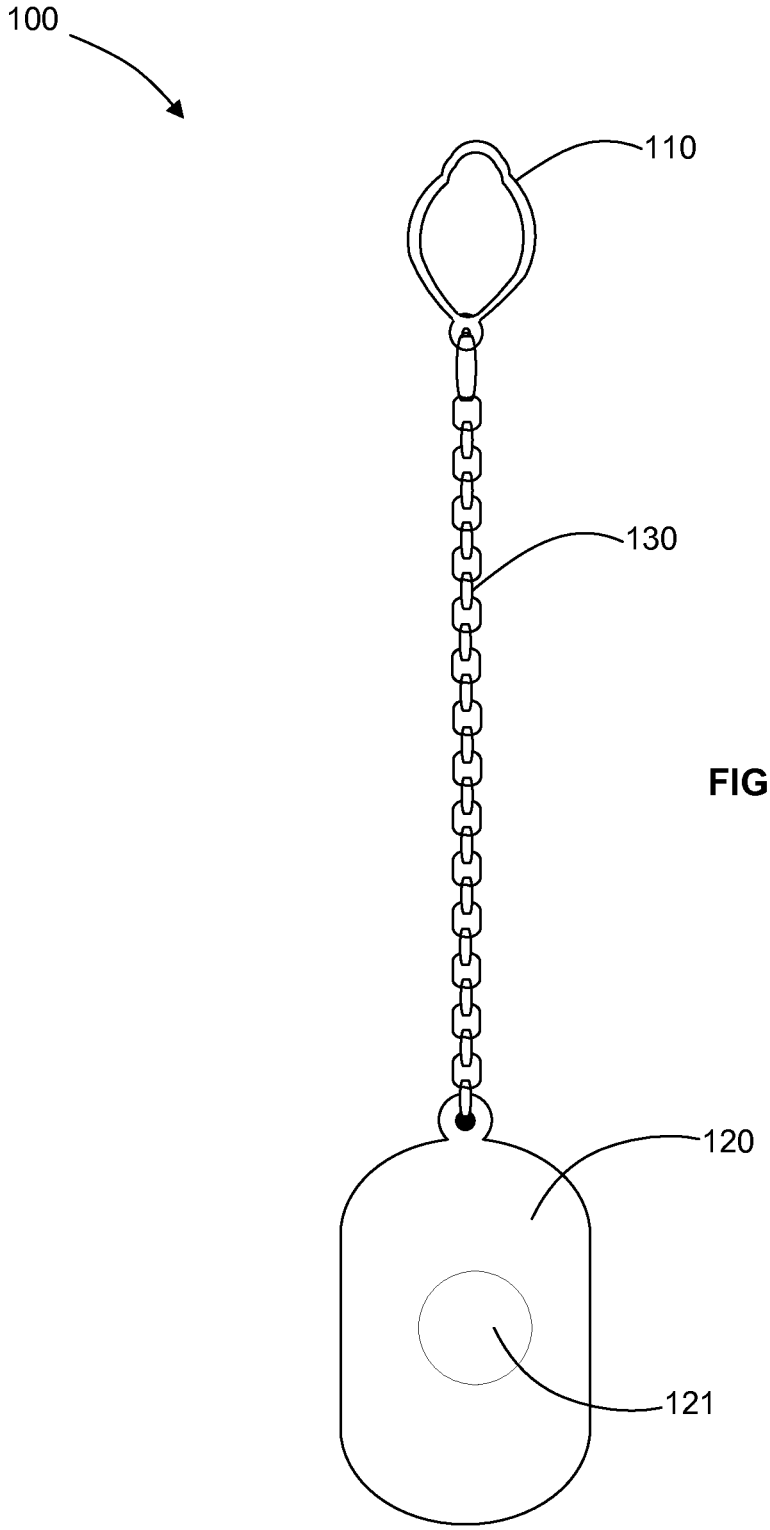
FIG. 1 is an illustration of a first component of a magnetic tie clip, according to one embodiment of the invention.

FIG. 1 illustrates one embodiment of the first component 100. The first component 100 may include a button fastener 110, a first magnetic member 120 and a connecter 130. Specifically, the button fastener 110 is coupled with the first magnetic member 120 using the connector 130. The shape of the button fastener 110 is not particularly limited, but can be configured so as to secure the first component 100 to the button 200 on the shirt. For example, the button fastener 110 can be a hook or closed loop that may be disposed behind a button and on top of threads that attach the button with the shirt. As shown in FIG. 1, the button fastener 110 may be a closed loop having generally a semi-circle or half-ellipse near the top of a larger semi-circle or half-ellipse. With the semi-circle or half-ellipse shapes, the button fastener 110 can be hooked over the button with the larger semi-circle portion (see FIG. 2), after which the smaller semi-circle portion of the button fastener 110 falls down onto the threads securely fastens the first component 100 to the shirt.

First magnetic member 120 is also not particularly limited and can be any material that can be used to form a magnetically attractive force sufficient to couple the first component 100 and the second component 300. In some embodiments, the first magnetic member 120 includes a paramagnetic material (e.g., certain metals, such as aluminum) that can be magnetically attracted to a magnet 340 on the second component 300 (see FIG. 3). For example, first magnetic member 120 may be a thin metal plate that is magnetically attracted to the magnet 340 disposed on the second member 300.

In some embodiments, first magnetic member 120 includes a ferromagnetic material (e.g., iron, nickel, cobalt, certain alloys of rare earth metals, and the like) that can be magnetically coupled with a paramagnetic material and/or ferromagnetic material on the second component 300. For example, the second component 300 could include aluminum that can be magnetically coupled to the ferromagnetic material. As another example, the second component 300 could include a ferromagnetic material configured to be magnetically coupled with the ferromagnetic material on first component 100 (e.g., configured so that opposing poles face each other).

In one embodiment, the first magnetic member 120 may include other materials that cannot form magnetic attraction. For example, the first magnetic member 120 may include a plastic mold that is affixed to a permanent magnet.

The first magnetic member 120 may have various shapes. In some embodiments, first magnetic member 120 may include a female engaging portion (not shown) that accommodates physical coupling with a male engaging portion (not shown) on the second component 300. As an example, the female engaging portion of the first magnetic member 120 may be a metal plate having a rounded indentation 121 in its center. The indentation may generally correspond to a rounded protrusion which extends outward from the second component 300 which is the male engaging portion. The rounded protrusion may be a magnet 340 itself (see FIG. 4). Thus, upon magnetic coupling, the male engaging portion on the second component 300 may fit within a corresponding rounded indentation in the first component 300, which may result in improved coupling (e.g., a stronger attractive force). Using similar principles, the male engaging portion could be included on the first magnetic member 120, while the second component 300 may have the corresponding female engaging portion.

First magnetic member 120 may optionally have a total weight to achieve a desired restriction of the movement of the tie. For example, a lightweight first magnetic member 120 may allow greater motion than a heavy first magnetic member 120. As an example, the first magnetic member 120 may have a total weight of between about 10 grams (g) and about 200 g. Moreover, first magnetic member 120 may be lightweight so that an individual may not notice that additional weight of the tie clip. To prevent the weight of the magnetic member from being noticeable, the magnetic member 120 may have a total weight of between about 25 g and about 500 g.

Figure 2:
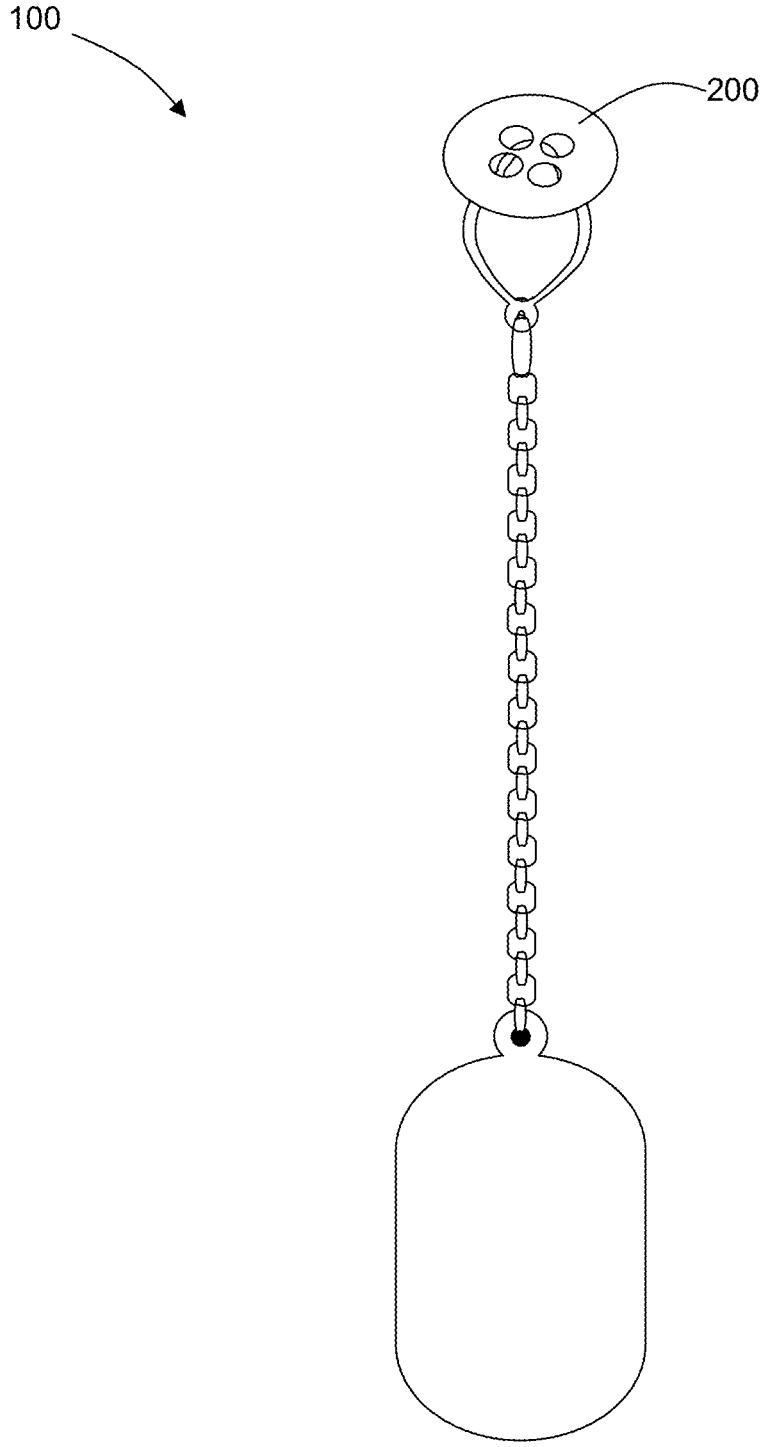
FIG. 2 is an illustration of the first component of the magnetic tie clip attached with a button, according to one embodiment of the invention.

Connector 130 is also not particularly limited and may be any structure that couples (e.g., joins) the button fastener 110 and first magnetic member 120. Connector 130 may be configured so that the first magnetic member 120 hangs below the button fastener 110 that is secured to the button. As an example, FIG. 2 shows the first component 100 fastened to the button 200. Non-limiting examples of the connector 130 include a rope, an elastic band, a chain, and the like. The connector 130 should be a flexible, non-rigid material so that the first magnetic member 120 can freely move as the second component 300 moves. In FIG. 2, the connector 130 is a chain.

In some embodiments, the connector 130 may be adjustable so that the length at which first magnetic member 120 hangs below the button fastener 110 may be modified. Various adjustable connectors are known to those skilled in the art. For example, the connector 130 may include a clasp (not shown) to adjust the length of the connector 130 by looping an excess portion of the connector 130 and affixing it to the connector 130 using the clasp.

The length of connector 130 is not particularly limited and may be selected to achieve the desired restraint of the tie. For example, a longer connector 130 may provide greater vertical freedom of motion for the tie, which is advantageous when the wearer changes from a standing to a sitting position. In one embodiment, the connector 130 may be between about 1 to about 20 centimeters (cm).

Figure 3:
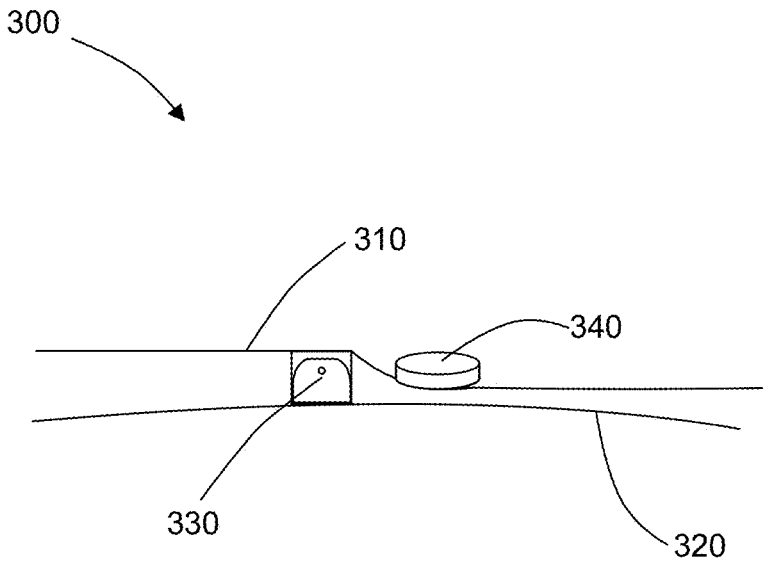
FIG. 3 is a side view illustration of the second component of the magnetic tie clip, according to one embodiment of the invention.

FIG. 3 illustrates one embodiment of the second component 300. In this embodiment, the second component 300 includes a front arm 310 and a back arm 320 that are rotatably coupled by hinge 330. The front arm 310 or back arm 320 can optionally include second magnetic member 340. Front arm 310 does not require a magnetic component. Thus, in some embodiments, from arm 310 excludes magnetic member 340.

Figure 4:
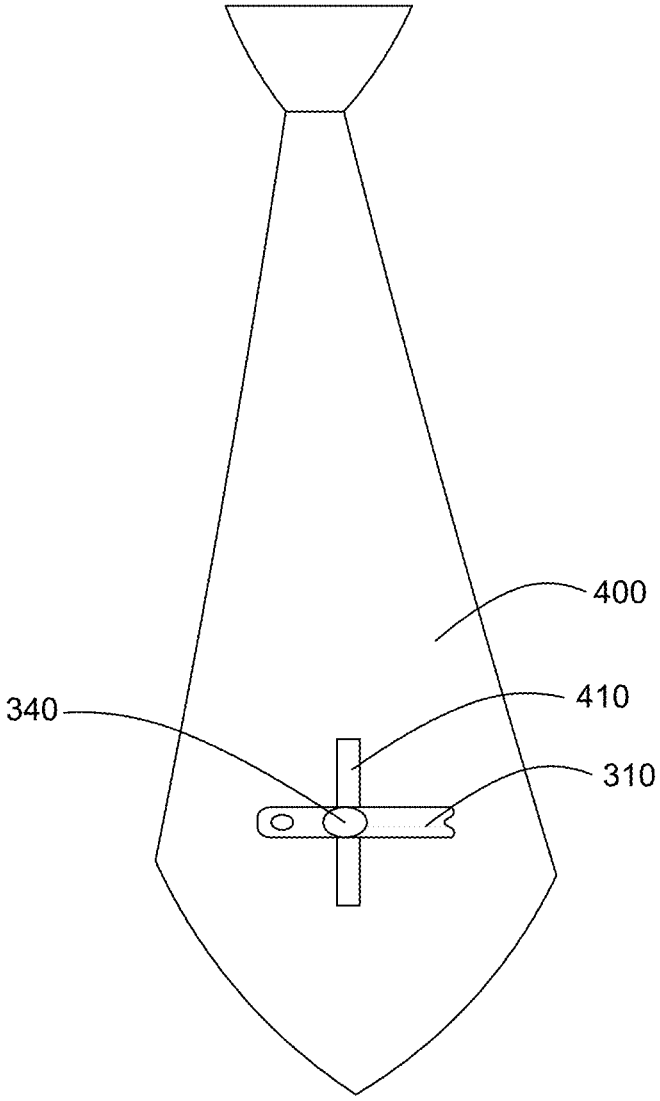
FIG. 4 is a front view of the second component of the magnetic tie clip on a tie, according to one embodiment of the invention.

The structure and materials for front arm 310 and back arm 320 is not particularly limited. For example, in one embodiment, front arm 310 is a solid member, while back arm 320 includes a slit or opening 315 (see FIGS. 5A and 5B). The structure may be any configuration that is capable of securing the second component 300 to a tie. For example, front arm 310 and back arm 320 may be generally flat, rectangular-shaped objects so that the back arm 320 can be inserted behind a securing member on the back of a tie. FIG. 4 shows one embodiment of the second component 300 secured to a tie 400 having a securing member 410. Front arm 310 faces away from tie 400 so that second magnetic member 340 can be magnetically coupled with the first component 100.

As another example, second component 300 may be configured to be secured to a tie by disposing back arm 320 over the front of tie 400 and front arm 310 is disposed behind tie 400. In some embodiments, back arm 320 may include a decorative design that will be visible over the front of tie 400.

Front arm 310 and back arm 320 may be rotatably coupled so that the arms can be separated while securing the second component 300 to the tie 400. As an example, the two arms may be coupled using hinge 330. Pressure may be applied on one side of the hinge 330 to open the arms on the opposite side. Second component 300 may then be disposed for securing to tie 400, and then the pressure can be released so that the arms close together. Of course, other means of fastening the second component 300 to a tie may be used and are within the scope of the present application.

As depicted in FIG. 3, front arm 310 may include a curved surface. The curved surface may be configured so that the top of the second magnetic member 340 is generally flush with at least a portion of front arm 310.

Meanwhile, the second magnetic member 340 may generally be selected to include the same material discussed above with respect to first magnetic member 120. Any material that can be used to form a magnetically attractive force sufficient to couple the first component 100 with the second component 300 is suitable. The material may be paramagnetic or ferromagnetic, and can be selected to form a corresponding magnetic attraction. For example, second magnetic member 340 may be a ferromagnetic material that is configured to be attracted to first magnetic material 120.

Figure 5A:
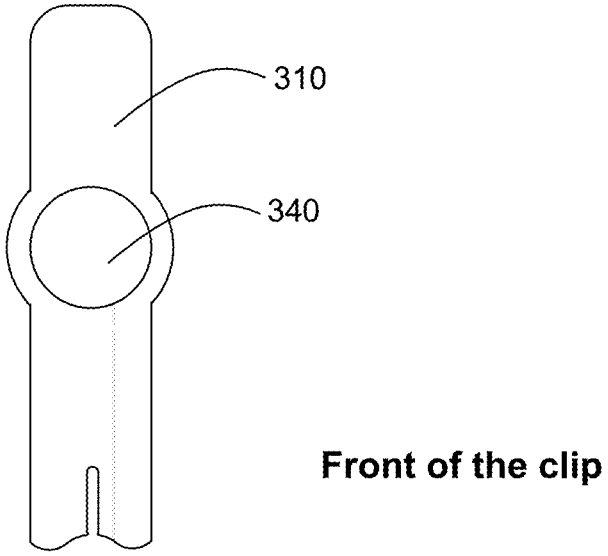
FIGS. 5A and 5B are front and rear views of the second component of the magnetic tie clip, according to one embodiment of the invention.
Figure 5B:
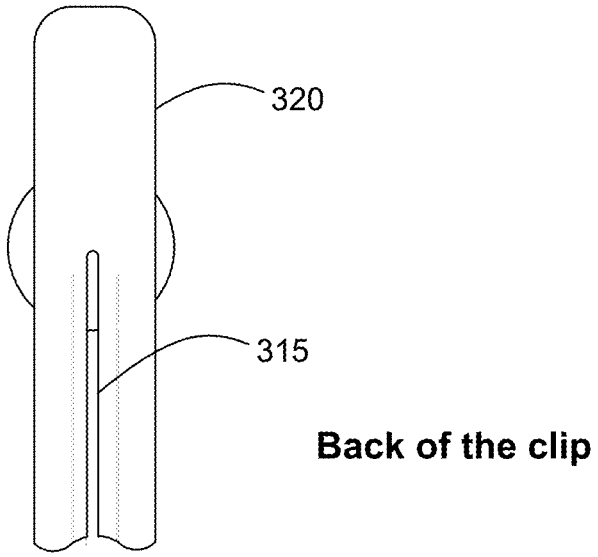

FIGS. 5A and 5B show front and back views, respectively, of one embodiment of the second component 300, respectively.

In some embodiments, a second magnetic material is not present. The front arm 310 may include a paramagnetic or ferromagnetic material that allow magnetic coupling with the first component 100. For example, the front arm 310 may be aluminum that can be magnetically coupled to a ferromagnetic material on the first component 100.

In some embodiments, second component 300 may include a female engaging member or a male engaging member which is configured to engage with an opposing engaging member on the first component 100. For example, a second engaging member may include an outward extending structure that engages an indentation on first component 100 (not shown).

In some embodiments, the second component 300 is integrated with the tie. For example, tie 400 may include a paramagnetic material stitched within the tie. The second component 300 may then be magnetically coupled with the first component 100 such that the second component is not visible.

Figure 6:
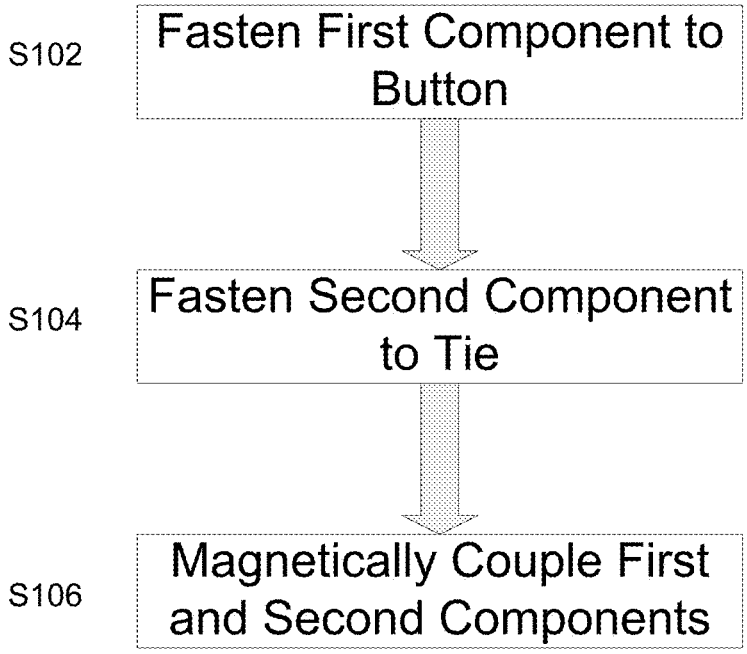
FIG. 6 is a flow chart illustrating a method of using the magnetic tie clip, according to one embodiment of the invention.

One or more methods of using the tie clip are disclosed and illustrated in FIG. 6. In a first step S102, the method may include fastening a first component to a button on a shirt. In step S104, the second component is fastened to a tie. Next, in step S106, the first component and the second component are magnetically coupled. The first and second component in this method can be any of those embodiments discussed above.

The above description of disclosed embodiments is provided to enable any person skilled in the art to make or use the invention. Various modifications to the embodiments will be readily apparent to those skilled in the art, the generic principals defined herein can be applied to other embodiments without departing from spirit or scope of the invention. Thus, the invention is not intended to be limited to the embodiments shown herein but is to be accorded the widest scope consistent with the principals and novel features disclosed herein.

What is claimed is:

1. A magnetic tie clip, comprising:

a first component including a substantially flat button fastener, a first magnetic member, and a connector connecting the button fastener to the first magnetic member, the button fastener including a top side including a hooking portion configured to hook onto a button thread, and further including a bottom side coupled to the connector connection;

a second component including a tie fastener configured to secure the second component to a tie and further including a second magnetic member, the second magnetic member fixed to the tie fastener and configured to form a magnetic couple with the first magnetic member, the tie fastener including a front arm upon which the second magnetic member is fixedly disposed, a rear arm, and a hinge that rotatably connects the front arm with the rear arm wherein the first magnetic member is a flat plate made of paramagnetic material with an indentation in the flat plate corresponding to and configured to receive said second magnetic member.

2. The magnetic tie clip of claim 1, wherein the connector flexibly connects the button fastener with the first magnetic member.

3. The magnetic tie clip of claim 1, wherein the button fastener is a closed loop.

4. The magnetic tie clip of claim 3, wherein the closed loop includes a major axis and a minor axis, the major axis sufficiently large that the closed loop can be hooked over a button of a shirt, the minor axis narrower than the button; and wherein the connector is fastened to the button fastener at one end of the major axis.

5. The magnetic tie clip of claim 1, wherein the magnetic first member is a ferromagnetic material.

6. The magnetic tie clip of claim 1, wherein a length of the connector is adjustable.

7. The magnetic tie clip of claim 6, wherein the connector is a chain.

8. The magnetic tie clip of claim 1, wherein the front arm is a ferromagnetic material which functions as the second magnetic member.

9. The magnetic tie clip of claim 1, wherein the second magnetic member is a paramagnetic material.

10. The magnetic tie clip of claim 1, wherein the second magnetic member is a ferromagnetic material.

11. The magnetic tie clip of claim 1, wherein the first magnetic member weighs between about 10 grams and about 500 grams.

12. The magnetic tie clip of claim 1, wherein the first magnetic member is a metal plate.

13. The magnetic tie clip of claim 1, wherein the connector has a length between 1 to about 20 centimeters.

14. The magnetic tie clip of claim 1, wherein the front arm and the rear arm clamp together on one side of the hinge, and are opened by squeezing the front arm and the rear arm together on the opposite side of the hinge.

15. A method of securing a tie to a shirt, comprising:

connecting a first magnetic member of a first component to a substantially flat button fastener with a connector set to a length which provides for flexible movement of a first magnetic member relative to the button fastener, the button fastener having a top side including a hooking portion, and a bottom side coupled to the connector;

fastening the button fastener of the first component to a button on a shirt by hooking the hooking portion onto a button thread of the button on the shirt;

fastening a second component with the tie via a tie fastener of the second component, the tie fastener having a front arm hingably coupled to a rear arm such that a portion of the tie is between the front arm hingably coupled to the rear arm; and magnetically coupling the first magnetic member of the first component with the second component using a second magnetic member fixedly disposed on the front arm of the second component wherein the first magnetic member includes an indentation in the flat plate corresponding to and configured to receive said second magnetic member.

* * * * *